US006189276B1

(12) United States Patent
Pinto et al.

(10) Patent No.: US 6,189,276 B1
(45) Date of Patent: Feb. 20, 2001

(54) DECORATIVE BASEBOARD MOLDING

(76) Inventors: Mark Z. Pinto; Lana M. Pinto, both of 24391 Via Madrugada, Mission Viejo, CA (US) 92692

( * ) Notice: Under 35 U.S.C. 154(b), the term of this patent shall be extended for 0 days.

(21) Appl. No.: 09/369,810

(22) Filed: Aug. 6, 1999

(51) Int. Cl.[7] ..... E04B 2/00
(52) U.S. Cl. ..... 52/288.1; 52/287.1
(58) Field of Search ..... 52/287.1, 288.1, 52/290, 718.02, 717.05

(56) References Cited

U.S. PATENT DOCUMENTS

| | | | | |
|---|---|---|---|---|
| 2,346,264 | * | 4/1944 | Marshall | 52/287.1 |
| 2,887,739 | * | 5/1959 | Bensman | 52/287.1 |
| 2,915,794 | * | 12/1959 | Hillmann | 52/287.1 |
| 3,201,910 | | 8/1965 | Keesee | 52/716 |
| 3,422,584 | | 1/1969 | Howard | 52/98 |
| 3,462,900 | | 8/1969 | Morrissey | 52/312 |
| 3,676,974 | * | 7/1972 | Daly | 52/288.1 X |
| 3,899,859 | | 8/1975 | Smith | 52/287 |
| 4,109,434 | | 8/1978 | Katzin | 52/287 |
| 4,586,304 | | 5/1986 | Flamand | 52/309 |
| 4,593,511 | | 6/1986 | Hakasaari | 52/404 |
| 4,622,791 | * | 11/1986 | Cook et al. | 52/287.1 X |
| 4,680,911 | | 7/1987 | Davis et al. | 52/521 |
| 4,845,910 | * | 7/1989 | Hanson et al. | 52/287.1 |
| 4,870,795 | | 10/1989 | Bard et al. | 52/389 |
| 4,930,286 | | 6/1990 | Kotler | 52/177 |
| 4,949,520 | | 8/1990 | Bear | 52/288 |
| 5,203,941 | | 4/1993 | Spain et al. | 156/209 |
| 5,232,751 | | 8/1993 | Cameron et al. | 428/15 |
| 5,457,923 | | 10/1995 | Logan et al. | 52/288.1 |
| 5,553,431 | * | 9/1996 | Pelosi et al. | 52/287.1 |
| 5,765,330 | | 6/1998 | Richard | 52/309.13 |
| 5,949,132 | * | 11/1999 | Margarit | 52/288.1 X |

* cited by examiner

*Primary Examiner*—David M. Purol

(57) ABSTRACT

The invention includes an overlay molding strip. The molding strip has an outer decorative surface and an inner surface. The inner surface includes a flat, upper wall-abutting portion attachable to a section of a wall above an existing baseboard molding. The inner surface further includes a recessed, lower portion for overlaying at least a portion of the existing baseboard molding. During use, the upper wall-abutting portion of the overlay molding strip is attached to a section of a wall above an existing baseboard molding to overlay at least a portion of the existing baseboard molding, obviating any need to remove the existing baseboard molding. This application, without removing the existing baseboard molding, spares much time, expense and aggravation.

11 Claims, 1 Drawing Sheet

DECORATIVE BASEBOARD MOLDING

BACKGROUND OF THE INVENTION

1. Field of the Invention

The present invention relates to millwork products and more particularly to baseboard and baseshoe moldings.

2. Description of the Related Art

In all homes, town homes, condominiums, apartments and other structures, including older office buildings, there exists a molding strip where the wall surface meets the finished floor. That molding strip is called the baseboard (or base) molding. Baseboard molding is applied at the intersection of the walls and the floor to cover unsightly imperfections that arise as a result of the uneven finished gap that invariably occurs wherever the wall and the floor meet.

In addition, in cases where the baseboard molding is applied but it does not completely cover the gaps between the finished wall and the finished floor or in cases where a floor has been remodeled with a new finished product such as wood flooring that has been installed without first removing the existing baseboard molding, an additional molding is applied to completely seal the gaps or cover the finished edge of the new floor covering. That molding is called a baseshoe (or toe) molding.

Baseboard and baseshoe moldings are applied to walls at the floor line using finish nails and/or construction adhesive of some variety. In most cases the moldings are installed by professional finish carpenters. All of the molding corners are mitred wherever walls change directions. The molding is applied as a permanent structure—a permanent finish trim in a room at the floor line.

If an individual wishes to remove the baseboard molding or the baseshoe molding at a later date as part of a remodeling project for a room or a structure, the removal becomes a painstaking, expensive, time-consuming process. Walls and floors invariably result in surface damage as a consequence of removing the baseboard and/or baseshoe moldings that were previously installed as a permanent part of the structure. Claw hammers, wedges, and pry bars must be used to remove the existing molding. As a result of the efforts to remove the old molding, nicks and even holes can be left in walls and floors. Also, flooring, paint and wallpaper can be damaged.

The molding removal takes much time, as only short sections of moldings will come off with each removal attempt. Much care must be taken to minimize wall and floor damage. Without exception, both wall and floor will require repair after the old molding has been removed. In addition, in cases where walls, wallpaper, paint, and flooring have been damaged, the repairs will be expensive.

OBJECTS AND SUMMARY OF THE INVENTION

It is therefore a principal object of the present invention to provide a baseboard molding that is applied over existing baseboard and/or baseshoe moldings without removing the existing moldings.

This and other objects are achieved by the present invention which in its broad aspects includes an overlay molding strip. The molding strip has an outer decorative surface and an inner surface. The inner surface includes a flat, upper wall-abutting portion attachable to a section of a wall above an existing baseboard molding. The inner surface also includes a recessed, lower portion for overlaying at least a portion of the existing baseboard molding. During use, the upper wall-abutting portion of the overlay molding strip is attached to a section of a wall above an existing baseboard molding to overlay at least a portion of the existing baseboard molding, obviating any need to remove the existing baseboard molding. This application, without removing the existing baseboard molding, spares much time, expense and aggravation.

Other objects, advantages, and novel features will become apparent from the following detailed description of the invention when considered in conjunction with the accompanying drawings.

BRIEF DESCRIPTION OF THE DRAWINGS

The same reference characters designate the same parts or elements throughout the drawings.

DETAILED DESCRIPTION OF THE PREFERRED EMBODIMENTS

Figure 1:
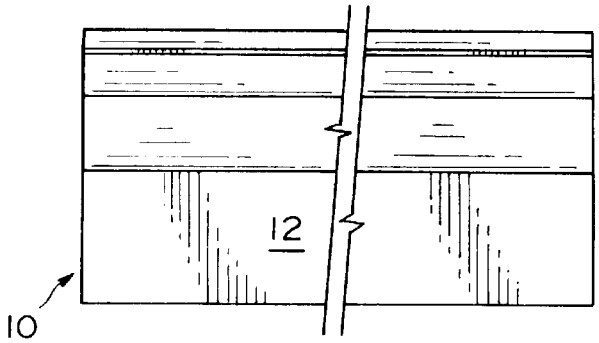
FIG. 1 is a front plan view of the decorative baseboard molding of the present invention.
Figure 2:
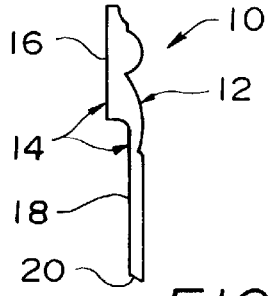
FIG. 2 is an end view of the decorative baseboard molding of FIG. 1.

Referring now to the drawings and the characters of reference marked thereon, FIGS. 1 and 2 illustrate a preferred embodiment of the present invention, designated generally as 10. The overlay molding strip 10 includes an outer decorative surface, designated generally as 12, and an inner surface, designated generally as 14. The inner surface 14 includes a flat, upper wall-abutting portion 16 and a recessed lower portion 18.

The overlay molding strip 10 may be wood-based or formed of a plastic-based material and is preferably solid. If wood-based it may be, for example, formed of pine, oak, mahogany, particleboard, (e.g. (MDF) medium density fiberboard) or other common wood-based material. Common plastic-based materials maybe PVC, vinyl, acrylic or polycarbonates. The outer decorative surface 12 may be smooth, textured, unfinished, finished, primed, painted, paper covered, etc. The specific outer mold line shown in the figures for surface 12 has been shown for the purposes of illustration and not limitation.

The recessed lower portion 18 is recessed, for typical applications, from the upper wall-abutting portion 16 by a distance in a range of from about ⅜ inch to ⅝ inch. The recessed, lower portion 18 preferably has a height in a range of about 1½ inch to 3½ inch.

There is an angled portion 20 on the lower end of the recessed lower portion 18 of the inner surface 14. Angled portion 20 is provided for the reasons discussed below.

Figure 3:
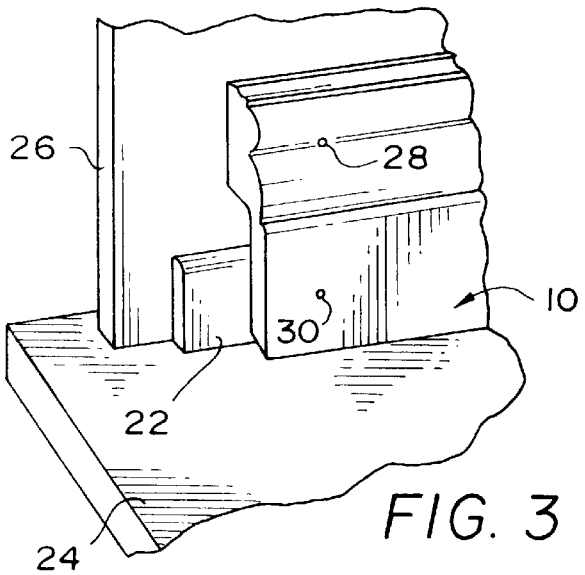
FIG. 3 is a perspective view showing the attachment of the baseboard molding of the present invention over an existing baseboard molding at a floor/wall intersection.
Figure 4:
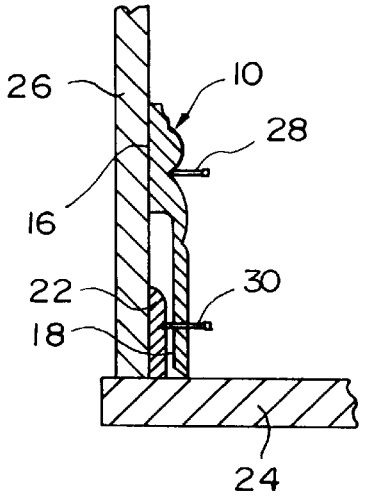
FIG. 4 is an end view of the FIG. 3 environment.

Referring now to FIGS. 3 and 4, a first application environment is illustrated showing attachment of the baseboard molding 10 of the present invention over an existing baseboard molding 22 at a floor 24/wall 26 intersection. The existing baseboard molding 22 has already been attached at the intersection of the floor 24 and the wall 26 to cover the unsightly gaps and imperfections that invariably occur at such intersections. It is understood that existing baseboard moldings have a variety of dimensions that can be accommodated by the present invention.

In application, the flat upper wall-abutting portion 16 is attached to the wall 26 of the location above the existing baseboard molding 22. It maybe securely attached by a nail 28 and/or an adhesive, such as construction/panel adhesive. The recessed, lower portion maybe secured to the existing baseboard molding 22 by a nail 30. An air space may be created between the recessed lower portion 18 and the outer surface of the baseboard molding 22.

Figure 5:
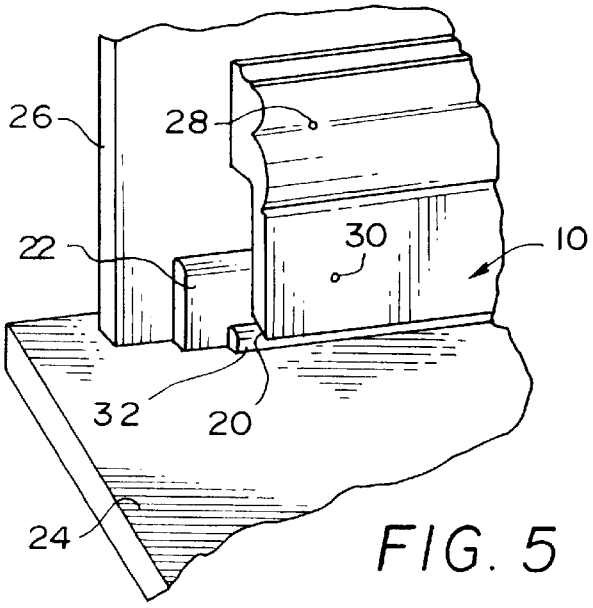
FIG. 5 is a perspective view showing the attachment of the baseboard molding of the present invention over an existing baseboard molding and baseshoe molding at a floor/wall intersection.
Figure 6:
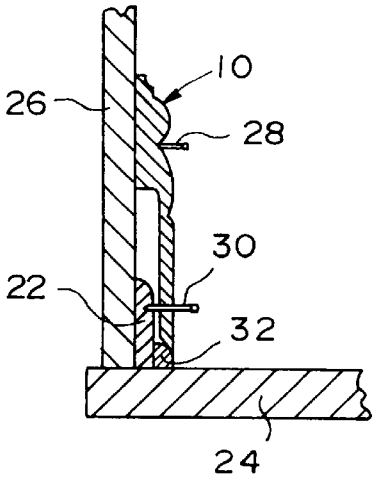
FIG. 6 is an end view of the FIG. 5 environment.

Referring now to FIGS. 5 and 6, another application environment is illustrated showing attachment of the baseboard molding 10 over an existing baseboard molding 22 having an existing baseshoe molding 32 positioned in front thereof. In the FIGS. 5 and 6 environment, the bottom of the recessed lower portion 18 is positioned adjacent to the existing baseshoe molding 32. The bottom is preferably angled to provide a proper transition between the baseshoe molding 32 and the baseboard molding 10. The angled portion 20 preferably makes the transition as smooth as possible. Nails and/or adhesive is used to attach the baseboard molding 10, as discussed above relative to the previous environment.

The present invention is particularly applicable for use in remodeling situations to provide an "upgraded" look. The ranges in dimensions discussed above relative to the recessed, lower portion 18 provide universal applicability of the baseboard molding 10 for a wide range of existing molding situations.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A decorative baseboard molding for use with an existing baseboard molding, said existing baseboard molding affixed to an intersection of a wall and a floor, said decorative baseboard molding, comprising:

an overlay molding strip, comprising:

a) an outer decorative surface; and b) an inner surface, including:

i) a flat, upper wall-abutting portion attachable to a section of a wall above an existing baseboard molding; and ii) a recessed, lower portion for overlaying at least a portion of the existing baseboard molding, wherein, during use, said upper wall-abutting portion of said overlay molding strip is attached to a section of a wall above an existing baseboard molding to overlay at least a portion of the existing baseboard molding obviating any need to remove the existing baseboard molding.

2. The decorative baseboard molding of claim 1, wherein said recessed, lower portion is substantially flat and recessed from the upper wall-abutting portion by a distance in a range of from about ⅜ inches to ⅝ inches.

3. The decorative baseboard molding of claim 1, wherein said overlay molding strip comprises particleboard.

4. The decorative baseboard molding of claim 3, wherein said particleboard comprises MDF (medium density fiberboard).

5. The decorative baseboard molding of claim 1, wherein overlay molding strip is solid.

6. The decorative baseboard molding of claim 1, wherein said recessed, lower portion of said inner surface comprises an angled portion.

7. The decorative baseboard molding of claim 1, wherein said overlay molding strip is a wood-based product.

8. The decorative baseboard molding of claim 1, wherein said overlay molding strip comprises plastic.

9. A method for providing a decorative baseboard molding, comprising the steps of:

a) providing a overlay molding strip, comprising:

an outer decorative surface; and an inner surface, including:

a flat, upper wall-abutting portion attachable to a section of a wall above an existing baseboard molding; and a recessed, lower portion for overlaying at least a portion of the existing baseboard molding; and b) attaching said overlay molding strip to the wall by attaching said upper wall-abutting portion of said overlay molding strip to a section of the wall above an existing baseboard molding to overlay at least a portion of the existing baseboard molding, obviating any need to remove the existing baseboard molding.

10. The method of claim 9, wherein an existing baseshoe molding is positioned on the floor in front of the existing baseboard molding, said step of attaching said overlay molding strip to the wall comprising positioning a bottom of said recessed lower portion of the inner surface adjacent to the existing baseshoe molding.

11. The method of claim 9, wherein said step of attaching said overlay molding strip to the wall comprises positioning a bottom of said recessed lower portion of the inner surface adjacent to the floor.

* * * * *